US006601589B2

(12) United States Patent
Ericks

(10) Patent No.: US 6,601,589 B2
(45) Date of Patent: Aug. 5, 2003

(54) HAIR TIE AND FASTENER

(76) Inventor: Dorvin Paul Ericks, 3027 B Autumnwood Dr., Huntsville, AL (US) 35816

( * ) Notice: Subject to any disclaimer, the term of this patent is extended or adjusted under 35 U.S.C. 154(b) by 0 days.

(21) Appl. No.: 09/925,913

(22) Filed: Aug. 9, 2001

(65) Prior Publication Data

US 2002/0017309 A1 Feb. 14, 2002

Related U.S. Application Data

(60) Provisional application No. 60/224,110, filed on Aug. 9, 2000.

(51) Int. Cl.[7] ..... A45D 8/04; A45D 8/12

(52) U.S. Cl. ..... 132/273; 132/275

(58) Field of Search ..... 132/275, 273, 132/212, 200; 24/298, 30.5 P, 3.13, 16 PB, 17 B, 17 AP

(56) References Cited

U.S. PATENT DOCUMENTS 5,271,127 A * 12/1993 Christensen ..... 24/16 R
5,404,892 A * 4/1995 Bretl ..... 132/200
5,577,698 A * 11/1996 Liu et al. ..... 248/214
5,758,390 A * 6/1998 Villeneuve ..... 24/16 R
5,778,904 A * 7/1998 Elsner ..... 132/275
5,839,169 A * 11/1998 Edwards et al. ..... 24/16 PB
5,881,435 A * 3/1999 Jermyn ..... 24/16 PB
5,901,416 A * 5/1999 Mears ..... 24/16 PB
6,032,680 A * 3/2000 Lu et al. ..... 132/275
6,196,033 B1 * 3/2001 Dowdle ..... 70/16
6,256,845 B1 * 7/2001 Tseng ..... 24/298

* cited by examiner

*Primary Examiner*—John J. Wilson
*Assistant Examiner*—Robyn Kien Doan
(74) *Attorney, Agent, or Firm*—Joseph H. Beumer

(57) ABSTRACT

A hair tie and fastener device has a cord formed into a loop, with one end of the cord stopping at the loop and the other end extending outward. The short end is formed into or connected to a restraining mechanism which controls reversible movement of the longer portion of the cord. The restraining feature may be a noose or slipknot formed into the cord, a keeper plate for use with a compressible cord or a spring-biased pawl mechanism. Movement from a hair-grasping position to a hair-releasing position is thus enabled.

6 Claims, 2 Drawing Sheets

HAIR TIE AND FASTENER

CROSS REFERENCE TO RELATED APPLICATION

This application claims the benefit of Provisional Application Ser. No. 60/224,110; filed Aug. 9, 2000.

FIELD OF THE INVENTION

This invention relates to hair ties and fasteners for hair ties.

BACKGROUND OF THE INVENTION

Hair ties are used to hold hairdoes such as ponytails in place and to restrain long hair from unwanted movement. Such devices generally take the form of a plastic clasp or an elastic band or cord encircling a hair tuft and secured by a fastener. Desirable features for hair ties include simplicity and ease of insertion and removal, provision of a firm, secure hold on the hair without damaging it, capability for being made decorative and low cost of manufacturing. Previously known hair ties and fasteners have generally been deficient in one or more of these features. U.S. Pat. No. 5,778,904, issued Jul. 14, 1998 to Elsner, exemplifies prior hair tie fasteners.

SUMMARY OF THE INVENTION

The present invention is directed to a hair tie and fastener comprising a cord made into a loop, the cord having a pair of terminal ends, with a first, shorter cord portion extending from an outer extremity of the loop to a first terminal section connected to or formed into a releasable restraint means and a second, longer cord portion being engageable by said restraint means and extending past the restraint means for a distance such as to allow movement of the restraint means along the longer loop portion from a hair-engaging position to a hair-releasing position. Tightening of an encircled hair tuft into a secured position may be carried out by placement of the expanded loop around the hair, sliding the restraint means inwardly to tighten the loop and securing the restraint means in locked position for embodiments where this function is not performed automatically by the restraint means.

The restraint means may comprise a noose or slipknot formed into the first terminal end, with the second cord portion passing through the noose or slipknot in a manner such that the knot may be moved inwardly and outwardly by grasping the knot and applying sliding force. When the loop securely engages a tuft of hair, the knot will not move outward to become loosened on its own accord. For other embodiments the restraint means may comprise a mechanical clamping device, which allows movement of the clamping device in an inward direction to secure the loop, but prevents movement in an outward direction unless a release mechanism is actuated. A keeper plate in which a radially compressible cord is held may also be used under conditions such that the cord may be passed through the keeper only when intentionally pulled.

In embodiments using a noose or slipknot as the restraint means, a stop bead may be provided on the cord inside the loop so as to prevent inadvertent pulling of the loop through the knot. For embodiments using a mechanical clamping device or a keeper plate with compressible cord, no stop bead is employed because the cord in these instances is placed so as to remain accessible for being pulled in and out as required.

The extended second terminal end of the cord in all of the described embodiments may be used to support decorative objects such as beads, brightly colored wrappings or the like.

Hair tie fasteners of this invention provide distinct advantages in their simplicity and ease of use and removal, with only a minimum amount of physical dexterity being required.

DESCRIPTION OF THE PREFERRED EMBODIMENT

Figure 1:
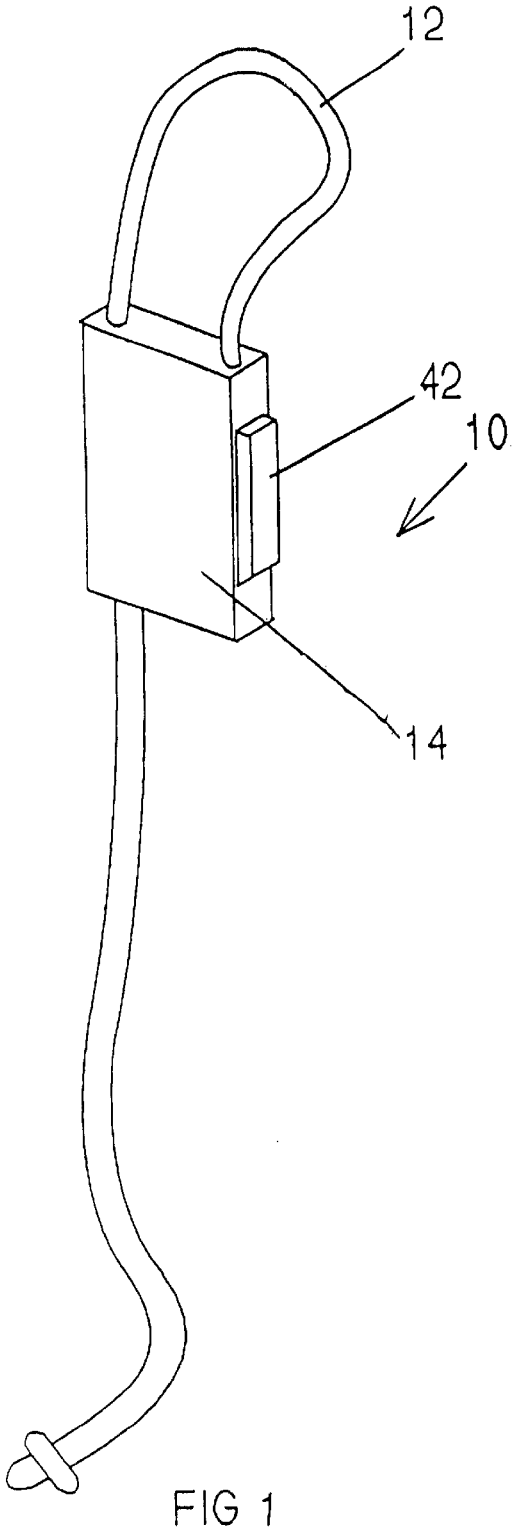
FIG. 1 is a perspective view of a hair tie and fastener embodying the invention.
Figure 2:
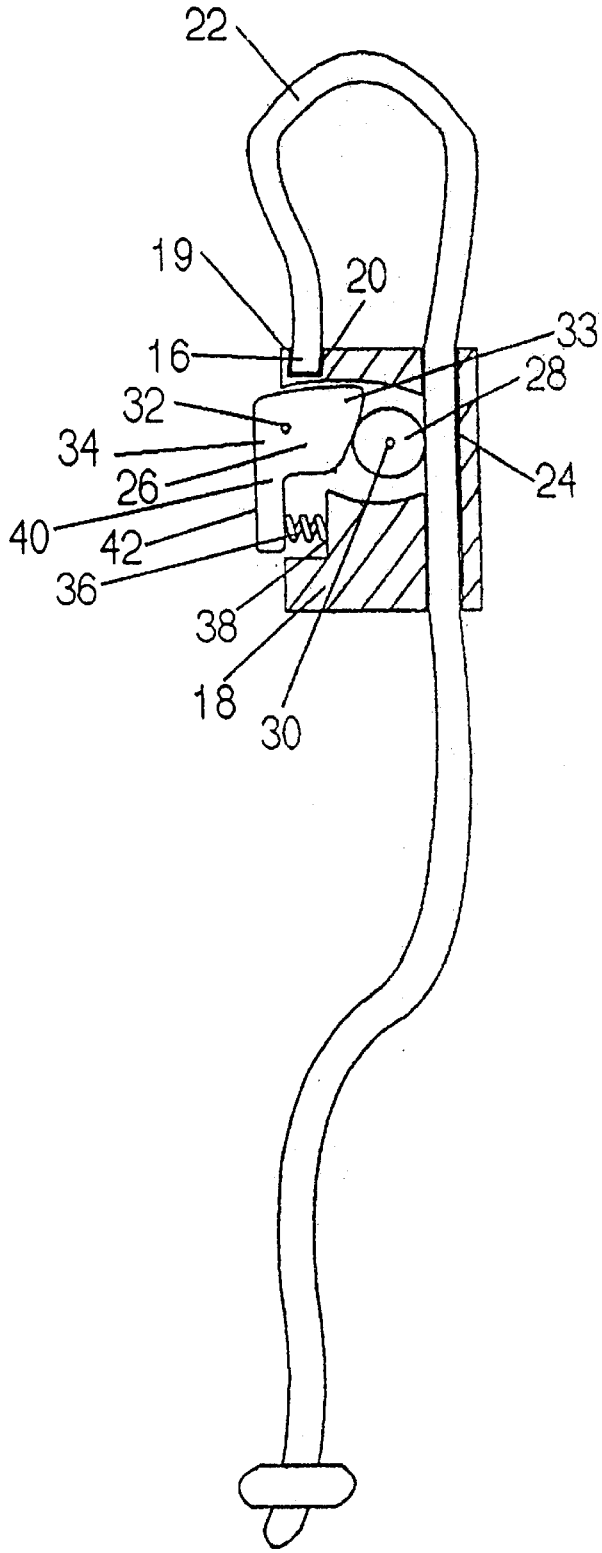
FIG. 2 is an enlarged view of the device of FIG. 1 with a cover partially removed to reveal details.

Referring to FIG. 1 of the drawings, there is shown a hair tie device 10 having a cord 12 supported by a case 14 in a manner such as to allow controlled movement and restraint of the cord. As shown in FIG. 2, one end 16 of the cord is secured to chassis 18 of the case at aperture 19 by means such as an adhesive 20. The cord is formed into a loop 22, which is used to engage a tuft of the user's hair. Chassis 18 has a channel 24 extending across its length, the channel receiving the cord and allowing it to move along the channel on a manner controlled by friction pawl mechanism 26. The pawl mechanism includes a smooth wheel 28 mounted on pivot pin 30 and placed to frictionally engage the cord so as to prevent cord movement except when this wheel is rotating. A pawl 34 mounted on pivot pin 32 has a first arm 33, which engages wheel 28, and a second arm 40 biased outward by spring 36. The spring is placed between surface 38 of the chassis and arm 40. Outer surface 42 of this arm serves as a pushbutton enabling movement of the first arm out of contact with the wheel and thus allowing free movement of the cord in both directions. When the pushbutton is released, movement of the wheel is restrained so that the cord will not become loosened of its own accord, but will remain in tightened position until the button is pressed and held down.

Figure 3:
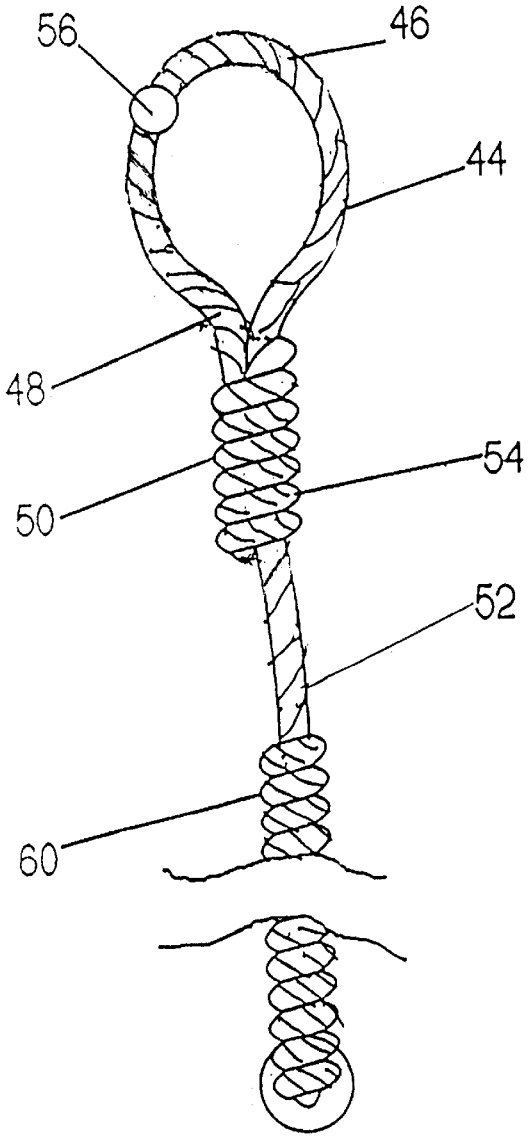
FIG. 3 is a front elevational view of a hair tie and fastener employing a noose as a restraint means.

FIG. 3 shows an embodiment and wherein a cord 44 is formed into a loop 46, with a shorter terminal end portion 48 incorporated in a slipknot or noose 50, and a longer terminal end portion 52 extending through the noose. The noose has seven turns 54 of the cord encircling portion 52 with portion 52 extending straight through the noose. This allows portion 52 to be pulled through the noose in either direction if the noose is grasped in one hand and the cord of portion 52 is pulled with the other hand. However, when the loop is tightened around a tuft of hair it cannot be released unless the loop is held tightly. A stop bead 56 may be threaded onto the cord so as to prevent the loop from being inadvertently pulled through the noose, which would result in the loss of the noose. A decorative wrapping 60 of brightly colored fabric or the like may be provided on the terminal end portion 52 to give the device an enhanced appearance.

Figure 4:
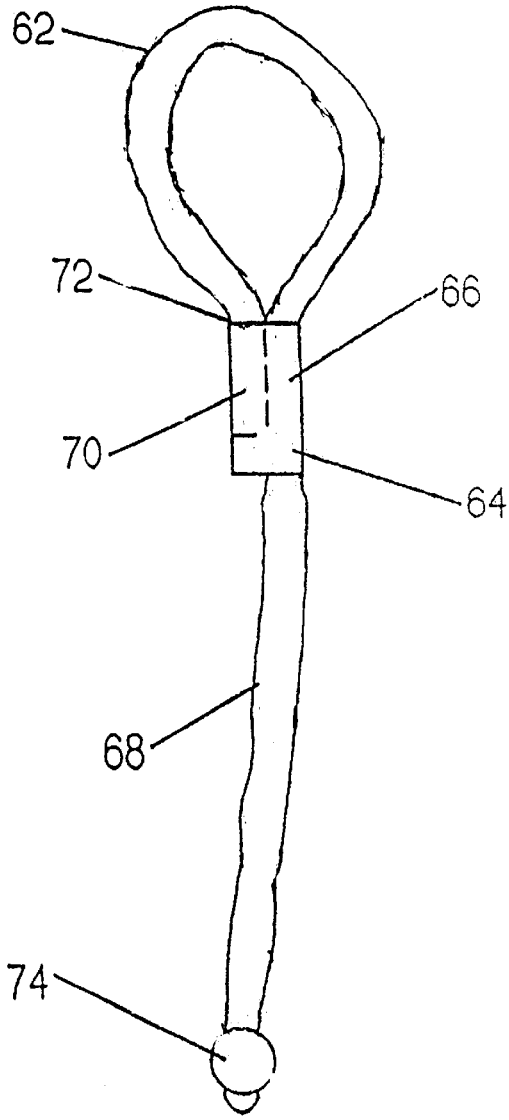
FIG. 4 is a front elevational view of a device employing a keeper that restrains a compressible cord.

In FIG. 4 an embodiment shown has a radically compressible cord 62 disposed in a channel 64 of a keeper housing 66, the cord being loose enough for the longer terminal end portion 68 to be pulled through the housing channel but tight enough to stay in position unless pulled. A shorter end portion 70 is secured to keeper housing 66 by being adhesive bonded to a receptacle 72 defined in the housing. The compressible cord for this embodiment may be made of a woven or spun synthetic or natural material such as cotton or nylon which exhibits significant compressibility in the radial direction, enabling the cord to return to its expanded shape when pulled away from the keeper. The cord itself may include decorative material incorporated into the cord or in an attached pendant 74.

In each of the embodiments shown, the device may be placed into use by gathering a tuft of hair and threading it into an expanded loop. The user then may bring the loop in position to retain the hair tuft by pulling the longer end portion outward with one hand and supporting the hair tuft, noose or other restraining means with the other hand. In removing the device, the loop may be enlarged for release by holding the noose or other restraint with one hand and depressing the pawl release where required while pulling inward on the longer end portion.

Other mechanisims may be used for the restraint means, including a rotating toothed gear and ratchet restricting movement to one direction as well as spring-actuated clamps or the like.

It is to be understood that various other minor modifications to the invention may be made by one skilled in the art without departing from the spirit and scope of the invention, which is limited only as indicated by the appended claims.

What is claimed is:

1. A hair tie and fastener device comprising a cord having a first end portion and a second end portion, a segment of said cord adjacent to said first end portion being formed into a loop and a restraining means fixedly connected to said first end portion and having defined therein an enclosed, side-inaccessible, open-ended channel receiving said second end portion threaded therethrough and further including means releasably engaging said cord whereby said loop may be tightened or loosened upon pulling the cord through said restraining means.

2. The device as defined in claim 1 wherein said restraint means comprises a noose formed by a plurality of turns of said first terminal end portion.

3. The device as defined in claim 1 wherein said restraint means comprises a slip knot formed into said first terminal end portion.

4. The device as defined in claim 1 wherein said cord is compressible in a radial direction and said restraint means comprises a generally tubular keeper housing releasibly engaging said cord under sufficient radial compression to hold said loop in hair-restraining position until said keeper is manually loosened.

5. The device as defined in claim 1 wherein said restraint means comprises a mechanical clamp having a case including a channel adapted to receive said second terminal end portion for movement therethrough, a wheel frictionally engaging said cord so as to restrain movement of the cord when the wheel is braked, a spring-biased pawl having an arm aligned for braking said wheel and a pivotally mounted pawl release arm, said first terminal end portion fixedly attached to said case.

6. The method of tying a tuft of hair in a desired position which comprises providing a hair tie device having a cord formed into a loop with a pair of terminal ends, a short terminal end portion fixedly connected to a restraining means and a longer end portion extending outward from said loop and passing through said restraining means enabling releasable engagement of the hair tuft; pulling said cord inward to provide an extended loop position and threading said tuft of hair into said expanded loop; and pulling said long terminal end outward with one hand while holding said hair tuft or restraint means with the other hand until said loop engages said tuft.

* * * * *